United States Patent [19]

Dufresne

[11] 4,213,842

[45] Jul. 22, 1980

[54] CAPPING BOARD FOR ELECTROLYTIC METAL REFINING

[76] Inventor: Jean L. Dufresne, 366 St. Germain, Drummond, Quebec, Canada, J0C 1K0

[21] Appl. No.: 51,226

[22] Filed: Jun. 22, 1979

Related U.S. Application Data

[63] Continuation of Ser. No. 934,080, Sep. 8, 1978, abandoned.

[30] Foreign Application Priority Data

Aug. 4, 1978 [CA] Canada ..... 308835

[51] Int. Cl.[2] ..... C25C 7/00; C25C 7/02

[52] U.S. Cl. ..... 204/279; 204/288

[58] Field of Search ..... 204/106, 279, 267, 297 R, 204/286, 288, 242, 281

[56] References Cited

U.S. PATENT DOCUMENTS

| | | | |
|---|---|---|---|
| 3,579,431 | 5/1971 | Jasberg | 204/281 |
| 3,697,404 | 10/1972 | Paige | 204/267 |
| 3,759,815 | 9/1973 | Larsson | 204/288 X |
| 3,763,029 | 10/1973 | Karn | 204/297 R X |
| 3,929,614 | 12/1975 | Hidohira | 204/297 R X |

*Primary Examiner*—John H. Mack
*Assistant Examiner*—D. R. Valentine
*Attorney, Agent, or Firm*—Schwartz, Jeffery, Schwaab, Mack, Blumenthal & Koch

[57] ABSTRACT

A capping board made of plastic material reinforced with fiberglass, for supporting the ends of a plurality of electrodes immersed in an electrolytic cell such as the cells used for the electrolytic refining of copper. This capping board is made of a plastic resin selected from the group consisting of polytetrafluoroethylene and acid resistant polyesters, vinylesters, epoxy and phenolic resins, and contains from 10 to 20% by weight of fiberglass, from 2 to 10% by weight of silica, from 2 to 10% by weight of mica and from 2 to 10% by weight of feldspar. Preferably, at least one wooden core is embedded in the capping board in order to reduce the quantity of resin required and the fabrication cost. Such capping boards made of reinforced plastic material allow for substantial increase in the productivity of electrolytic metal refining plants, in particular because they are resistant to corrosion and do not need to be frequently replaced.

8 Claims, No Drawings

FIG. 3
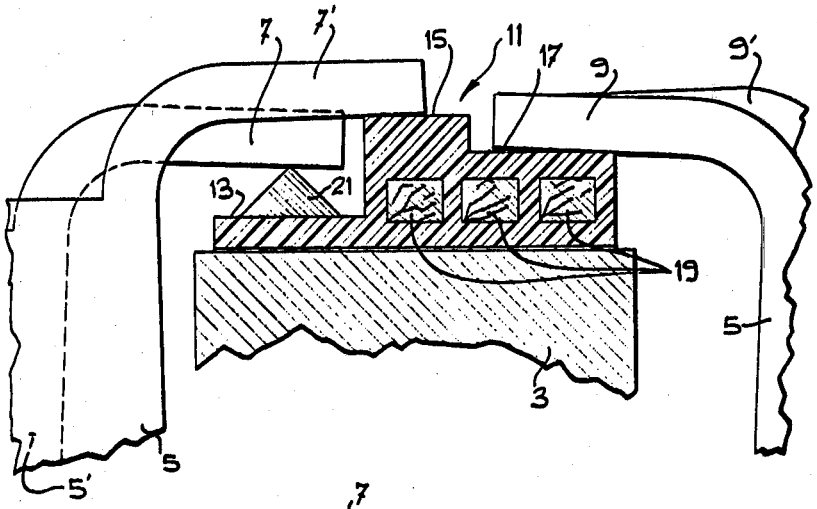
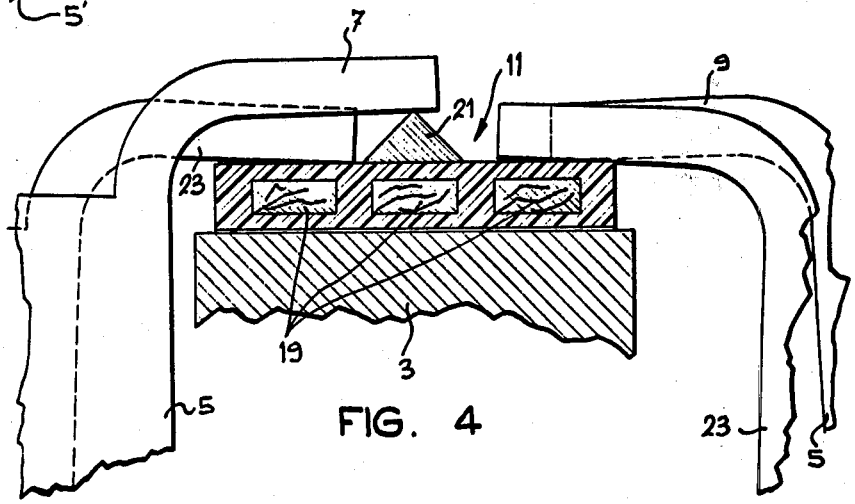
FIG. 4
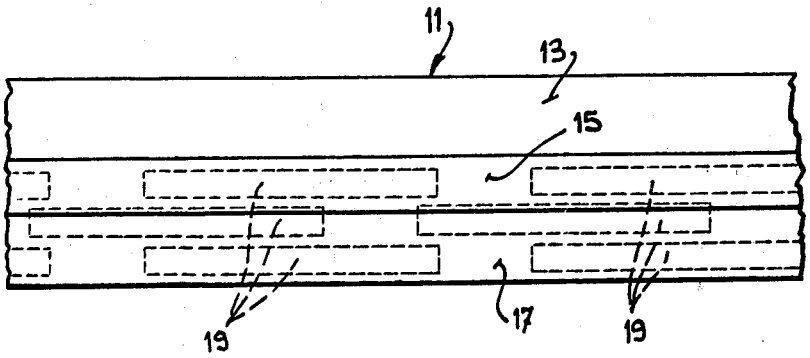
FIG. 5

CAPPING BOARD FOR ELECTROLYTIC METAL REFINING

This application is a continuation of co-pending U.S. patent application Ser. No. 934,080, filed Sept. 8, 1978, now abandoned. Priority is claimed based on Canadian patent application Ser. No. 308,835 filed Aug. 4, 1978.

BACKGROUND OF THE INVENTION

This present invention is concerned with a capping board made of plastic material reinforced with fiberglass, for supporting the ends of a plurality of electrodes immersed in an electrolytic cell, such as the cells used for electrolytically refining metal and more particularly the electrolytic refining of copper, nickel or zinc.

It is well known in the metallurgical industry to use a plurality of electrolytic cells for electrolyticly refining a metal. Usually, the metal to be refined is in the form of plates of a given thickness, which bear at their upper portion two laterally extending projections or ears used to facilitate gripping, handling and hanging of the plates on the lateral sides of each cell. These plates, which each can weigh several hundred pounds, are immersed into the cell parallel to each other and are used as anodes, cathodes or both, depending on the affinity of the metal being refined.

In order to avoid damage to the masonry or concrete forming the lateral sides of the cell during the insertion and removal of the electrodes because of their weight, it is a conventional practice to place a protecting or "capping" board made of wood on the top surfaces of the lateral sides of the cell on which the electrodes lie. The capping boards also serve to insulate the plates from each other.

These capping boards made of wood effectively protect the top portions of the lateral sides of the cells, however, they present a significant drawback in that they must frequently be replaced because they are corroded by the conventionally used acidic electrolytes or they are destroyed by the overheating that may occur in case of short circuit. Thus, for example, in almost every copper refining plant in which the electrolyte is a substantially concentrated solution of hydrochloric and sulfuric acids (20%), the wooden boards must be replaced every 10 to 20 days.

This replacement operation, which of course involves stopping of the cells during the substitution and also requires purchase and stocking of numerous replacement boards, is time consuming and very expensive in terms of inventory, equipment and maintenance staff costs, especially when one considers that the refining plants have up to 2,000 electrolytic cells. Disposal of the discarded boards by incineration or otherwise is also costly.

OBJECTS OF THE INVENTION

The object of the present invention is to provide a capping board made of plastic material reinforced with fiberglass, which capping board is resistant to compression, abrasion, moisture, heat and corrosion and which overcomes the above-mentioned drawbacks encountered when using wooden boards.

This object is achieved by providing a capping board made from a plastic resin selected from the group consisting of polytetrafluoroethylene and the polyester, vinylester, epoxy and phenolic resins resistant to corrosion by acids, which resins contain from 10 to 20% by weight of fiberglass, from 2 to 10% by weight of silica, from 2 to 10% by weight of mica and from 2 to 10% by weight of feldspar.

According to a preferred embodiment of the invention, the fiberglass is in the form of a pressed mat or a woven cloth. This mat or cloth is impregnated with the selected resin in which mica has been added, and then is folded or layered in a mold so as to form a plurality of layers and give the desired shape to the capping board. During the folding operation, the cloth is reimpregnated with the selected resin and the silica which is previously mixed with the resin, in order to ensure a perfect adhesion between the layers.

In order to reduce the viscosity of the resin and facilitate impregnation or reimpregnation of the fiberglass layers, the resin can be slightly modified by addition of 0 to 1% by weight of a dilution agent.

According to another preferred embodiment of the invention, at least one wooden core is embedded in the capping board in order to reduce the quantities of resin and additives that are necessary for obtaining a thick capping board. According to a further preferred embodiment of the invention, the resin is selected so that the resulting capping board is slightly flexible to fit the uneven sides of the concrete tank forming the electrolytic cells.

Some commercially available resins are sufficiently flexible to be used as such. However, use can be made of from 0 to 30% by weight of a flexibilizer introduced directly into the resin, together with the mica, if needed.

BRIEF DESCRIPTION OF THE DRAWINGS

The invention will now be explained in greater detail with reference to the following description made in connection with the accompanying drawings in which:

FIG. 3 is a cross section view of a capping board in use;

FIG. 4 is a cross section view of another capping board in use; and

FIG. 5 is a top plan view of the capping board shown in FIG. 3.

DESCRIPTION OF THE PREFERRED EMBODIMENTS

Figure 1:
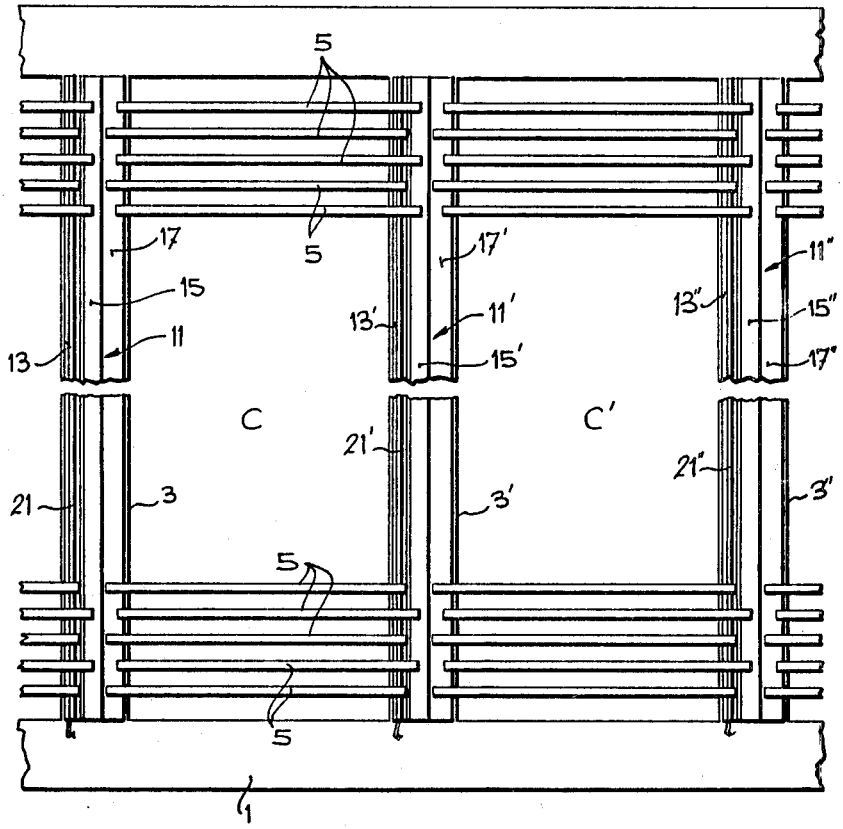
FIG. 1 is a partial top view of a plurality of electrolytic cells with the electrodes located side by side.
Figure 2:
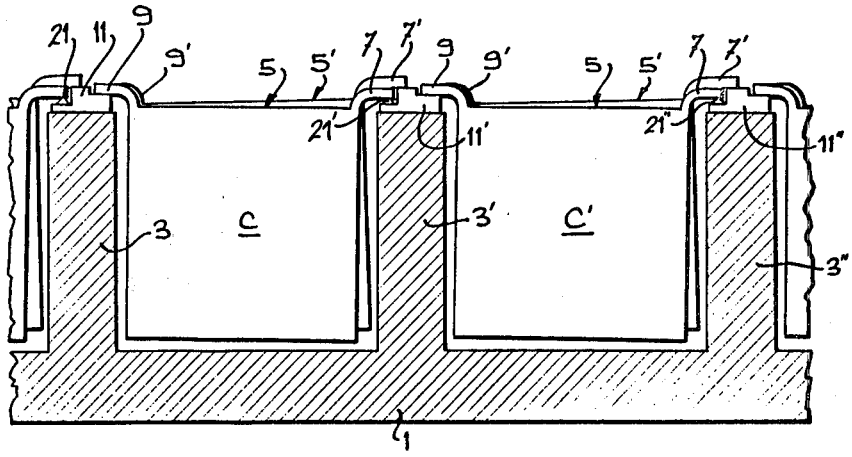
FIG. 2 is a partial view in cross section of the cells shown in FIG. 1.

FIGS. 1 and 2 each represent a plurality of electrolytic cells C,C' . . . located adjacent each other. These cells C,C' . . . which are used for refining a metal such as copper in an electrolytic manner, are substantially rectangular in shape and all of the same size to receive the same number of electrodes 5 made of metal to be refined.

The cells C,C' . . . are generally constituted by a tank 1 made of concrete and divided in sections by means of vertical partitions 3, 3', 3'' which are also made of concrete. A lead coating may be provided to cover and protect the concrete tanks.

Of course, the size of each cell depends on the number of electrodes 5 that it must receive, the size of the electrodes and the space that must be left between them. Thus, for example, in a copper refining plant, each cell generally is from 10 to 20 feet long and from 28 to 38 inches wide. The electrodes are located at spacings of about 4 inches.

The electrodes 5 are made of the metal to be refined. Each electrode is in the shape of a square having sides 2 to 3 feet in length. Each square is extended at the top to form two laterally extending projections 7 and 9. These projections 7 and 9 are used for gripping, handling, and hanging the electrodes 5 on the top surfaces of the vertical partitions 3, 3' and 3'' of the cells. The electrodes 5 are generally very heavy. For example, the electrodes used in copper refining generally weigh up to 700 pounds and can substantially damage the masonry of the tank 1 or partition by breaking or fissuring the concrete of the tank, this being particularly undesirable.

Accordingly, use in conventionally made of board 11, 11', 11'', usually referred to as a "capping board", for supporting the electrodes 5, protecting the top surfaces of the partitions 3, 3', 3'', . . . , preventing shocks from occurring when handling the electrodes 5, and avoiding damage caused by the heavy weight of the electrodes.

These boards 11, 11' and 11'' must be acid-resistant and perfectly insulated to the high electric charges used for electrolytically ionizing the metals. They also must not absorb moisture.

These boards 11, the width of which depends on the thickness of the partitions 3, further must resist the combined weight of the electrodes 5, which may amount to several tons. In addition, they must be resistant to the chemical compounds used as electrolyte, such as sulfuric and hydrochloric acids. Finally, they must resist peak temperatures up to 230° C. or sometimes up to 260° C. which can occur in case of a short circuit during the electrolytic operation.

As a result of many tests carried out with different materials and additives, a capping board has been found which meets all the above-mentioned requirements. This capping board is made of a plastic resin selected from the group consisting of polytetrafluoroethylene and the acid resistant polyester, polyvinylester, epoxy and phenolic resins, to which from 10 to 20% of fiberglass, from 2 to 10% of silica, from 2 to 10% of mica and from 2 to 10% of feldspar have been added.

As the plastic resin, use can be made of polytetrafluoroethylene. Use can also be made of acid-resistant polyester resins, such as those sold by the firm Reichhold Chemicals Ltd. under the registered trademarks "POLYLITE 33,402 and 31,830". Further, any high temperature epoxy resin, vinylester resin or phenolic resin can be used. Other thermoplastic resins have been found to be unable to withstand the heat developed during a short circuit.

In practice, an acid-resistant polyester resin is preferred because such resins are somewhat less expensive. They are also easy to handle and provide good material stability.

As fiberglass, use can be made of a woven fiberglass cloth in order to facilitate formation and molding of the capping boards, or of a pressed fiberglass mat, containing from 1 to 2 ounces of fiber per square foot. Preferably, a combination of a woven fiberglass cloth and a pressed fiberglass mat is used to obtain a good laminate quality.

Silica for use in the invention is commercially available from numerous sources. Satisfactory results have been obtained with a silica powder sold by the firm Industmin Ltd.

As mica and feldspar, use can be made of the mica flakes sold under the trademark SUZORITE and the feldspar sold by the firm La Violette Mining Inc.

The fabrication of the capping board according to the invention using the above described materials can be carried out by any conventional casting method.

Preferably, the fabrication will be carried out with a mold having the desired, final shape of the capping board to be produced according to the following procedure.

First of all, in order to facilitate extraction of the board after molding, a mold releasing agent is used that can be introduced in the resin as an additive. Alternately, wax can be previously spread onto the surfaces of the mold.

As mold releasing agent useful for faciliating withdrawal of the board, use can be made of any known agent compatible with the selected resin, such as for example, polyvinyl alcohol.

Before casting the capping board, it is desirable to incorporate the mica into the resin a few hours before using the latter. This improves the homogeneity of the resin mixture and resulting capping board by facilitating elimination of the air bubbles created by the introduction of the mica into the resin.

If needed, a curing agent can be introduced into the resin before its use in order to accelerate hardening of the same. As curing agent, use can be made of any conventional curing agent compatible with the selected resin, such as for example, methyl ethyl ketone peroxide in the amount of from 0 to 1% by weight relative to the total weight of the capping board.

Then, the fiberglass is impregnated with the mixture of resin and mica, and with the other additives.

If needed, a dilution agent or solvent can be introduced in the resin to dilute the same and reduce its viscosity. This facilitates the impregnation of the fiberglass and improves the homogeniety of the resulting capping board. Any conventional dilution agent compatible with the selected resin can be used as the solvent. A suitable solvent is sold under the trademark CLEARATE B 65 by the firm Lecithin Products Canada Ltd. The amount of solvent to be used depends on the viscosity desired for the resin. This amount preferably ranges from 0 to 1% by weight relative to the total weight of the resin.

In order to ensure complete impregnation of the fiberglass and to remove any air bubbles that may be contained therein, the fiberglass is mechanically pressed or, when using a cloth, manually rolled.

After impregnation of the fibers, the capping board is shaped. To accomplish this, the impregnated fiberglass is pressed or rolled in the mold until the desired final shape is obtained.

During this shaping, the silica and other additives are introduced into the resin by simple dusting, as the mold is filled up or, when use is made of a cloth of fiberglass, at every folding of the cloth.

In order to ensure a perfect homogeneity of the additives in the resin, silica advantageously may be impregnated with resin before being introduced between the layers of impregnated fiberglass.

In order to reduce the amount of resin, fiberglass and additives needed to produce a desired shape of the capping board, one or more hard wooden cores 19 can be introduced into the resin during the molding, provided that these cores are completely embedded in the resin and covered by a protective layer of from 0.5 to 1 inch in order to avoid direct contact between the embedded wood, the electrodes made of metal to be refined and the electrolyte used in the cell.

The number and the shape of the hard wooden cores that can be used depend on the thickness of the final capping board. Preferably, the dimensions of the hard wooden cores will be about 0.75×1×30 inches. Such cores may desirably be positioned in overlapping position in alternate parallel rows within the capping board.

The general shape and size of a capping board manufactured in this manner can vary within a large range, depending on the user's requirements. Generally, these capping boards 11 are cast in a single piece having the length of the vertical partition 3 on which they lie. This length usually ranges from 10 to 20 feet depending on the size of the electrolytic cells.

The capping boards 11 are also cast so as to have substantially the same width as the partition 3, which width usually ranges from 5 to 7 inches, typically from 5 to 6 inches.

The shape of the capping board 11 only depends on the user's requirements and the electrolytic refining method used.

By way of examples, two shapes of capping board are illustrated in FIGS. 3 and 5 and in FIG. 4, respectively.

The capping board shown in FIGS. 1 and 2 is illustrated in more detail in FIGS. 3 and 5. This board can be used with the electrolytic refining system known as the "series system", in which the electrodes 5 made of metal to be refined are located in parallel relationship and electrically connected in series in order to form the anodes and cathodes respectively. Such a system is used by the firm Canadian Copper Refiners Ltd. of Noranda, province of Quebec.

According to this system the electrodes are paired and one electrode of each pair is electrically connected to an electrical supply bar made of copper. When refining copper, these electrically connected electrodes form the anodes.

In order to faciliate this alternate electrical connection, the capping board 11 has, when seen in cross section, a first flat surface 13 extending at a low level of about 0.5 inch, a second flat surface 15 located at a high level of about 2 inches; and a third flat surface located at an intermediate level of about 1.5 inches relative to the upper flat surface of the partition 3.

The first surface 13 receives the electrical bar 21 used for supplying the anodes with electricity. This bar 21 is preferably of triangular cross section so as to rest stably on surface 13 and to allow for supply of powerful electrical charges.

Anodes 5 lie directly on this bar 21 through their lateral projections 7. The alternate electrodes 5' which are not electrically connected, rest on the second surface 15 through their lateral projections 7', thus reducing the risk of short circuits and allowing for use of a single electrical supply bar 21 for all the anodes of the cell.

At the other side of the cell, the electrodes 5 and 5' all rest on the third, common surface 17 through their lateral projections 9 and 9'.

The widths of the surfaces 13, 15 and 17 of course depend on the sizes of the lateral projections. When using a capping board having a total width of six inches, the widths of these surfaces 13, 15 and 20 can be about 2.25; 1.25 and 2.50 inches, respectively.

The capping board shown in FIG. 4 is much simpler than the above-described capping board and can be used with the electrolytic refining system known as the "multiple system" in which the electrodes 5 made of metal to be refined are located in parallel relationship but are separated from each other by means of intermediate electrodes 23 made of a different material. When refining copper, the intermediate electrodes can be made of iron or copper of different purity such as previously refined copper.

Such a system is used, for example, by the firm International Nickel Co. of Copper Cliff, province of Ontario, or by the United States Metal Refining Co. of Carteret, New Jersey.

In this particular case, the shape of the capping board is very simple since the intermediate electrodes 23 can have a width smaller than that of the electrodes 5. Thus, the capping board can be simply rectangular, as shown.

The location of the wooden cores 19 embedded in the resin of course depends on the shape of the capping board and on the thickness thereof. The size and shape of the wooden cores also will vary according to the final shape and thickness of the capping board. Thus, when use is made of a capping board having a thickness less than about 10 mm or ⅜ inch, no wooden cores are used. For a capping board 11 as shown in FIG. 3, the wooden cores 19 form three parallel rows extending along the length of the capping board and located at the same level relative to the upper surface of the partition 3, beneath the flat surfaces 15 and 17. For the capping board 11 shown in FIG. 4, the wooden cores 19 form three parallel rows located at the same level relative to the upper surface of the partition 3 and equally spaced apart across the width of the capping board. In both cases, the wooden cores 19 forming each row are spaced apart from each other along the row and located in an alternate overlapping manner with respect to the wooden cores of the adjacent rows, as shown in FIG. 5, in order to ensure a better strength and distribution of the weight of the electrodes along the capping board 11 while providing the latter with some flexibility.

In order to ensure stability of the capping board 11 on the top surface of the partitions 3, use is preferably made of a flexible resin, such as the above-mentioned polyester resin POLYLITE 31,830. Mixtures of such resins with less flexible resins such as a chloropolyester resin can be utilized. Use can also be made of a conventional flexibilizer compatible with the selected resin.

EXAMPLE I

Following the above-described method, several capping boards made of plastic material reinforced with fiberglass were manufactured by using the following materials, proportions being expressed in percent by weight:

| | |
|---|---|
| Flexible polyester resin POLYLITE 31.830 | 20% |
| Polyester resin POLYLITE 33.402 | 54% |
| Fiberglass mat or woven cloth | 14% |
| Feldspar | 2% |
| Silica | 5% |
| Mica Flakes | 4% |
| CLEARATE B 65 | 0.5% |
| Methyl ethyl ketone peroxide | 0.5% |
| | 100% |

The physical properties of the resulting boards were as follows:

| | |
|---|---|
| Compression resistance | 19,500 to 23,000 PSI |
| Barcol hardness | 60 to 80 |
| Temperature resistance | 200 to 240° C. |

-continued

| |
|---|
| (400 to 460° F.) |

EXAMPLE II

The boards of Example I were used for supporting copper electrodes in a refining plant using the above-described "series refining system". In this plant, the operating conditions were as follows:

| | |
|---|---|
| Refining tank length: | 16 feet |
| Refining tank width: | 40 inches |
| Refining tank depth: | 38 inches |
| Capping board length: | 17 feet 6 inches |
| Capping board width: | 6 inches |
| Spacing between copper plates: | 4 inches |
| Electrolytic bath | $H_2SO_4$(20%), HCl |
| Electrolytic power | 20,000 Amps through the anode, under a low voltage |
| Operating temperature | 90 to 130° F. |

The results obtained were more than satisfactory. After fifteen months of trial use on a continuous basis, all of the capping boards were still in perfect operating condition. The copper electrode load on the boards was fifteen tons per tank. The capping boards resisted the heavy load of the electrodes, the corrosion attack by the acid and the high temperature encountered during the refining process. These capping boards also resisted temperature picks of 400° F. that occurred because of a short circuit, without necessitating replacement or stopping of the refining unit.

The foregoing embodiments have been described as examples only and are not intended to be limiting. Since modifications thereof may occur to persons skilled in the art, the scope of the invention is to be limited soley by the scope of the appended claims.

What is claimed is:

1. A capping board for supporting the extremities of electrodes immersed into an electrolytic cell, said capping board being molded from a plastic resin selected from the group consisting of polytetrafluoroethylene and acid resistant polyester, vinylester, epoxy and phenolic resins containing from 10 to 20% by weight of fiberglass, from 2 to 10% by weight of silica, from 2 to 10% by weight of mica and from 2 to 10% by weight of feldspar.

2. A capping board according to claim 1, wherein the plastic resin contains at least one additive selected from the group consisting of mold releasing agents, resin diluting agents, curing agents and flexibilizers.

3. A capping board according to claim 2, wherein the mold releasing agents, diluting agents and curing agents are introduced into the resin in the amount of up to 1% by weight.

4. A capping board according to claim 3, wherein the fiberglass is a woven cloth or a pressed mat previously impregnated with said resin and mica, said cloth or mat being folded or rolled in layers so as to obtain the desired final shape and being reimpregnated with said resin and dusted with said silica and feldspar during the folding or rolling process to ensure good adhesion between the layers.

5. A capping board according to claim 4, comprising at least one hard wooden core embedded therein in order to reduce the quantity of resin required to form the board.

6. A capping board according to claim 5 comprising a plurality of elongated wooden cores arranged in staggered relation in parallel rows extending along the length of the capping board.

7. A capping board as claimed in claim 1, 4 or 5, comprising three flat, parallel surfaces defining together a central surface and two lateral surfaces located at different levels lower than that of the central surface.

8. A capping board as claimed in claim 3, 4 or 5, comprising:

| | |
|---|---|
| 20% | by weight of a flexible polyester resin |
| 54% | by weight of a chloropolyester resin |
| 14% | by weight of fiberglass; |
| 2% | by weight of feldspar; |
| 5% | by weight of silica; |
| 4% | by weight of mica flakes; |
| 0.5% | by weight of methyl ethyl ketone peroxide as curing agent and |
| 0.5% | by weight of a diluting agent. |

* * * * *